United States Patent [19]

Peitl et al.

[11] 3,989,093

[45] Nov. 2, 1976

[54] CONTINUOUS CASTING PLANT FOR SLABS

[75] Inventors: Josef Peitl, Haibach; Fritz Gränitz, Linz; Gerhard Reithner, Linz; Wilhelm Dutzler, Linz; Heinz Müller, Leonding; Ernst Bachner, Linz; Walter Fortner, Linz, all of Austria

[73] Assignee: Vereinigte Osterreichische Eisen- und Stahlwerke-Alpine Montan Aktiengesellschaft, Linz, Austria

[22] Filed: Mar. 14, 1975

[21] Appl. No.: 558,330

[30] Foreign Application Priority Data

Mar. 18, 1974 Austria ..... 2193/74
Feb. 17, 1975 Austria ..... 1141/75

[52] U.S. Cl. ..... 164/283 S; 164/89
[51] Int. Cl.[2] ..... B22D 11/124
[58] Field of Search ..... 164/283 R, 283 S, 283 M, 164/283 MS, 283 MT, 82, 83, 89, 49

[56] References Cited

UNITED STATES PATENTS

| | | | |
|---|---|---|---|
| 3,041,686 | 7/1962 | Hazelett | 164/89 X |
| 3,261,059 | 7/1966 | Properzi | 164/89 X |
| 3,463,220 | 8/1969 | Moritz | 164/89 X |
| 3,467,166 | 9/1969 | Getselev | 164/49 |
| 3,753,793 | 8/1973 | Wagener | 164/89 X |
| 3,766,968 | 10/1973 | Fortner | 164/283 S |
| 3,877,510 | 4/1975 | Tegtmeier | 164/283 S |

*Primary Examiner*—Francis S. Husar
*Assistant Examiner*—John S. Brown
*Attorney, Agent, or Firm*—Brumbaugh, Graves, Donohue & Raymond

[57] ABSTRACT

A continuous casting plant for slabs, comprising a water-cooled mould from which the strand is continuously extracted, a supporting and guiding means having rollers for guiding the strand between them, and a cooling device having nozzles for spraying a coolant, in particular water, onto the strand and the rollers, has a part of the cooling device formed by flat jet nozzles arranged parallel to the surface of the strand. The longitudinal axes of the nozzles are parallel to the axes of the rollers, and two flat jet nozzles are arranged between neighboring rollers. Advantageously, the flat jet nozzles are arranged within the area defined by the slab edges of the slab sizes to be cast in the plant, and advantageously they are arranged opposite and toward each other. Furthermore, the flat jet nozzles can have nozzle openings in opposite directions, each opening pointing toward the slab edges. Advantageously, the flat jet nozzles are displaceable in the direction of the roller axes and are thus adjustable to various slab widths.

2 Claims, 4 Drawing Figures

CONTINUOUS CASTING PLANT FOR SLABS

BACKGROUND OF THE INVENTION

The invention relates to a continuous casting plant for slabs comprising a water-cooled mould, from which the strand is continuously extracted, a supporting and guiding means with rollers that guide the strand between them and a cooling device with nozzles through which a coolant, for example water, is sprayed on the strand and the rollers.

It has been known (U.S. Pat. No. 3,766,968) to form a part of the cooling device by flat jet nozzles which are arranged parallel to the surface of the strand, i.e. to the broadside of the slab, their longitudinal axes being parallel to the axes of the rollers. This configuration of the cooling device aims at cooling the outer faces of the rollers facing the strand surface, which faces are exposed to an intensive heat radiation, and at preventing local thermal overstressing of the rollers. In this apparatus the flat jet nozzles are arranged outside of the slab edges between neighbouring rollers in alternating order at opposite slab edges each, so that the coolant jet of a flat jet nozzle is sprayed over the entire side of the slab from one edge to the other one. It has been shown that in the area of tertiary cooling of the strand, i.e. in the zone in which the cooling of the strand is not exclusively effected by direct spraying with water, but is effected mainly by removing the heat from the strand via the machine parts, a more intensive cooling is desired than is obtained by an alternating arrangement of the flat jet nozzles.

SUMMARY OF THE INVENTION

The present invention solves the problem of tertiary cooling by changing the arrangement according to the above patent, so that two flat jet nozzles are arranged between each neighbouring pair of rollers. Thus, two coolant jets are available for the cooling of each one of the rollers, so that the outer face of a roller facing the slab can be cooled at both sides of the contacting line with the slab by one coolant jet each. This intensive cooling is especially important for rollers that are not driven and which lose contact with the slab and thus stand still.

Advantageously, the flat jet nozzles are arranged within the area defined by the slab edges of the slab sizes to be cast in the plant. Thus a direct spraying of the slab edges is no longer possible. This embodiment is especially advantageously applied in the casting of very narrow slabs in which a direct admission of the coolant jet to the slab edges leads to a supercooling of the edges, which in turn can lead to the formation of cracks in the edges.

Advantageously, the flat jet nozzles are arranged within each other so that the coolant jets, which are directed towards each other, meet in about the middle of the slab. Due to this arrangement, which advantageously is applied for the flat jet nozzles used for the cooling of the lower side of the slab, an intensive whirling and atomization occurs in the area of the middle of the slab, where the coolant jets meet. Thus, the coolant is better exploited and the parts of the rollers bearing the greatest stress, i.e. in the middle of the strand, are better cooled.

The invention also comprises flat jet nozzles having nozzle openings in opposite directions, each pointing toward the edges of the slabs. By this nozzle arrangement a direct admission of the coolant to the slab edges is prevented in spite of an intensive spraying of the entire width of the slab.

Furthermore, it is advantageous that the flat jet nozzles are displaceable in the direction of the roller axes and can be adjusted to the widths of the slab sizes to be cast. Thus an optimal adjustability of the coolant jets is guaranteed for the widest as well as for the narrowest slab to be cast in the plant.

BRIEF DESCRIPTION OF THE DRAWINGS

The invention shall now be described in greater detail with reference to the drawings, in which.

DESCRIPTION OF EXEMPLARY EMBODIMENTS

Figure 1:
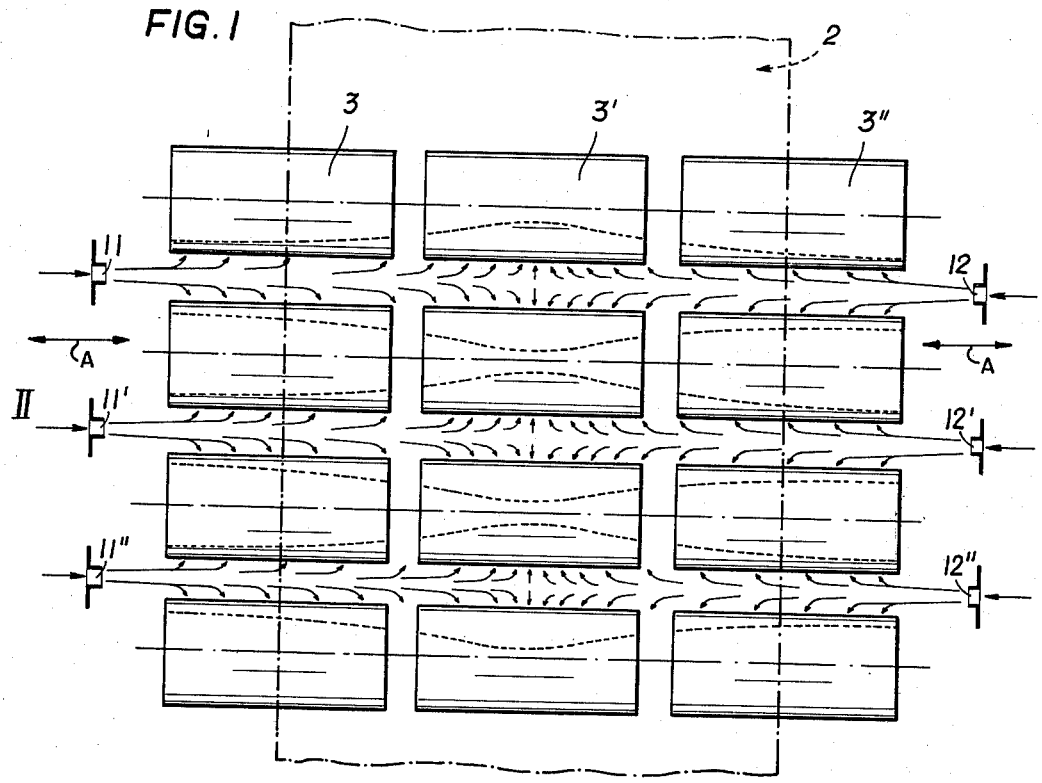
FIG. 1 is a view on the strand guiding rollers according to an embodiment of the invention.

The strand 2 of FIG. 1 is extracted from a mould (not shown) and is guided by supporting and guiding rollers in a secondary cooling zone where direct cooling occurs. After this secondary cooling zone, the strand is further cooled in a tertiary cooling zone until it has solidified throughout. The heat from the strand in the tertiary zone is not removed by direct cooling with water, but is removed mainly by indirect cooling due to contact with the rollers. The rollers provided in the tertiary cooling zone advantageously are formed as divided rollers 3, 3′ and 3″. These rollers are arranged on roller supports 4 and 4′.

Figure 3:
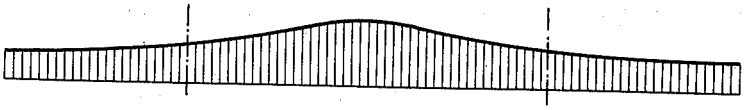
FIG. 3 shows the cooling water quantity profile according to FIG. 1.
Figure 2:
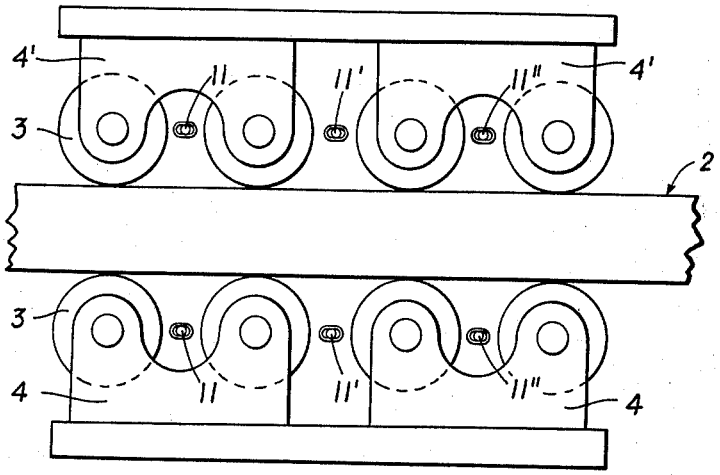
FIG. 2 is a view in the direction of the arrow II of FIG. 1.

According to the embodiment of the invention shown in FIGS. 1 and 2, one row of flat jet nozzles is arranged on each side of the slab so that there is a pair of nozzles between each pair of neighbouring rollers. The nozzles 11, 11′ and 11″ are opposite the nozzles 12, 12′, 12″. The coolant jets of the nozzle pairs (11 and 12), (11′ and 12′) and (11″ and 12″) are thus directed towards each other and meet in the area of the middle rollers 3′. As a result the coolant quantity profile shown in FIG. 3 is created. The profile is also shown in FIG. 1 in broken lines.

Figure 4:
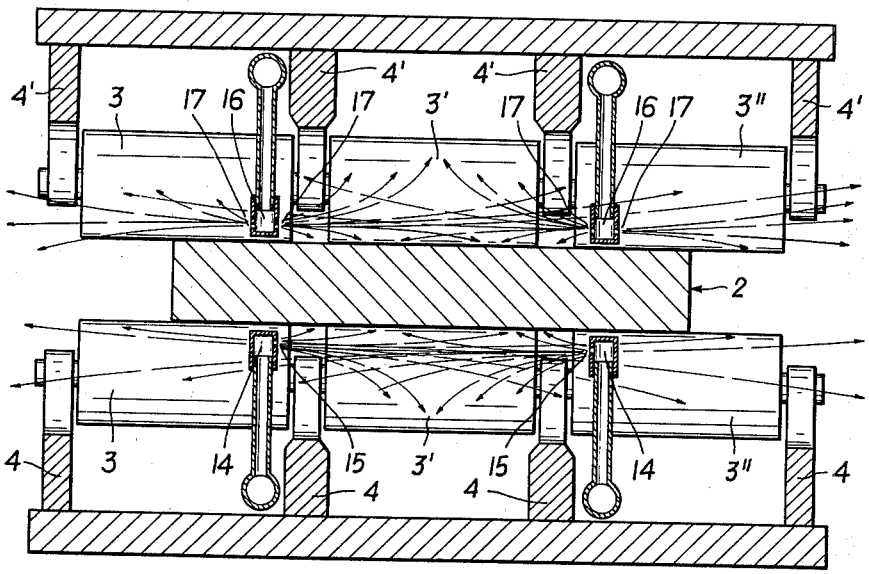
FIG. 4 is a section perpendicular to the direction of movement of the slab through the continuous casting plant according to another embodiment of the invention.

According to FIG. 4 which represents another embodiment of the invention, flat jet nozzles 14 and 16 are arranged between the rollers within the area defined by the slab edges of the slab sizes to be cast in the plant. The flat jet nozzles 14 provided for the cooling of the lower side of the slab lie opposite each other and have their nozzle openings 15 directed towards each other. The coolant jets of each nozzle meet in the area of the middle roller 3′ and are then directed both onto the roller parts lying behind the opposite flat jet nozzle as well as onto the areas of the slab edge supported by those roller parts and by the middle roller part. The flat jet nozzles 16 arranged at the upper side of the slab have nozzle openings 17 in both directions of the roller axes. Thus two coolant jets directed away from each other are formed, so that the rollers are cooled over their entire lengths and the slab is cooled over its entire width.

In either the embodiment of FIG. 1 or of FIG. 4 the flat jet nozzles are preferably displaceable in the direction of the roller axes, as indicated by arrows A in FIG. 1, in order to accommodate different width slabs.

We claim:

1. A continuous casting plant for forming slabs from cast strands comprising:

a supporting and guiding means having rollers for guiding the strand between them, and a cooling device having nozzles for spraying a coolant onto the strand and said rollers, said nozzles being supported by said supporting and guiding means, a part of said cooling device being formed by flat jet nozzles with first nozzle openings; said flat jet nozzles being arranged parallel to the broadside of the strand and to the axes of the rollers adjacent them, two of the flat jet nozzles being arranged between each pair of neighbouring rollers with their first nozzle openings being directed opposite and toward each other so that coolant jets are formed which meet in about the middle of the slab, at least some of the flat jet nozzles having second nozzle openings in the opposite direction from their first nozzle openings so that spray is directed toward the strand edges.

2. A continuous casting plant as set forth in claim 1, wherein the flat jet nozzles are displaceable in direction of the roller axes and are thus adjustable to various widths of slabs to be cast.

* * * * *